US008801401B2

(12) United States Patent
Yamashita

(10) Patent No.: US 8,801,401 B2
(45) Date of Patent: Aug. 12, 2014

(54) ELECTRICALLY POWERED PUMP

(75) Inventor: Takahisa Yamashita, Tokyo (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 149 days.

(21) Appl. No.: 13/231,140

(22) Filed: Sep. 13, 2011

(65) Prior Publication Data

US 2012/0076678 A1 Mar. 29, 2012

(30) Foreign Application Priority Data

Sep. 27, 2010 (JP) ..... 2010-215736

(51) Int. Cl.
*F04C 2/332* (2006.01)

(52) U.S. Cl.
USPC ..... 417/410.3; 418/173

(58) Field of Classification Search
USPC ..... 417/410.3, 352, 353; 418/158, 173, 418/241; 310/48
See application file for complete search history.

(56) References Cited

U.S. PATENT DOCUMENTS 4,509,906 A * 4/1985 Hattori et al. ..... 418/152
5,163,825 A * 11/1992 Oetting ..... 418/153
H1966 H * 6/2001 Henry et al. ..... 417/356

FOREIGN PATENT DOCUMENTS

JP 2003-129966 A 5/2003
WO WO2010096924 * 9/2010 ..... F04C 2/324

* cited by examiner

*Primary Examiner* — Bryan Lettman
(74) *Attorney, Agent, or Firm* — Foley & Lardner LLP

(57) ABSTRACT

An electrically powered pump includes a housing having a plurality of coils disposed in a circumferential direction of the housing, and an outer rotor rotatably disposed on an inner circumferential side of the housing and having a plurality of permanent magnets. The pump further includes an inner rotor disposed on an inner circumferential side of the outer rotor so as to be rotatable about a rotation axis eccentric relative to a central axis of the outer rotor. The inner rotor has a plurality of slots extending in a radial direction of the inner rotor, and a plurality of connection plates each having an outer radial end portion pivotably supported on an inner circumferential portion of the outer rotor and an inner radial end portion slidably received in the respective slots. The connection plates divide a space formed between the outer and inner rotors into a plurality of chambers.

8 Claims, 6 Drawing Sheets

ELECTRICALLY POWERED PUMP

BACKGROUND OF THE INVENTION

The present invention relates to an electrically powered pump which is used as an oil pump, etc., and particularly relates to an improvement of an electrically powered pump in which a motor section disposed on the radial outside of the electrically powered pump and a pump section disposed on the radial inside of the electrically powered pump are substantially integrally formed with each other.

Japanese Patent Application Unexamined Publication No. 2003-129966 discloses an electrically powered oil pump for use in an internal combustion engine and an automatic transmission for vehicles. The electrically powered oil pump of this conventional art has the construction of a generally known trochoid pump in which an outer rotor having permanent magnets is directly rotatably driven by coils disposed on the side of a housing, instead of the construction of a prior art in which an electric motor and a pump are connected with each other in series. Specifically, in the electrically powered oil pump of this conventional art, annular permanent magnets are fixed onto an outer circumferential surface of the outer rotor, and a core and coils are disposed on a housing which surrounds the outer rotor and the permanent magnets. The former corresponds to a rotor of a motor, and the latter corresponds to a stator of the motor. Further, an inner rotor of the generally known trochoid pump is disposed on the inner radial side of the outer rotor, and is rotated to follow rotation of the outer rotor. Thus, the electrically powered oil pump of this conventional art performs a pumping action thereof.

SUMMARY OF THE INVENTION

In the trochoid pump used in the electrically powered oil pump of the conventional art pump, four lobes of the inner rotor is in a meshing engagement with five recessed portions of the outer rotor. In such a trochoid pump, when the outer rotor is rotationally driven to allow the inner rotor to follow the outer rotor, the rotation of the outer rotor is transmitted to the inner rotor through substantially one of the four lobes which is engaged with the recessed portion of the outer rotor. Thus, transmission of the rotation of the outer rotor is performed through a local portion of the inner rotor, and therefore, a driving force of the outer rotor cannot be smoothly transmitted to the inner rotor. Further, the outer rotor and the inner rotor are directly contacted with each other, and the rotation number of the inner rotor is larger than the rotation number of the outer rotor because of the ratio between the number of the lobes and the number of the recessed portions. For this reason, the outer rotor must drive the inner rotor so as to increase the rotation number (i.e., the rotation speed) of the inner rotor. As a result, sliding resistance which occurs between the outer rotor and the inner rotor becomes extremely large to thereby make it difficult to actually use the electrically powered oil pump of the conventional art.

The present invention has been made in view of the above-described problems in the techniques of the conventional art. It is an object of the present invention to provide an electrically powered pump capable of being downsized as a whole and being used in practice.

In a first aspect of the present invention, there is provided an electrically powered pump including:

a housing comprising a suction port and a discharge port, the housing having a cylindrical inner circumferential surface having a circular shape in section, the housing further comprising a plurality of coils disposed in a circumferential direction of the housing, a cylindrical outer rotor rotatably disposed on an inner circumferential side of the housing, the outer rotor having a plurality of permanent magnets on an outer circumferential surface thereof which constitute a motor section in cooperation with the coils of the housing, an inner rotor disposed on an inner circumferential side of the outer rotor so as to be rotatable about a rotation axis eccentric relative to a central axis of the outer rotor, the inner rotor cooperating with the outer rotor to form a space therebetween which is communicated with the suction port and the discharge port, the inner rotor having a plurality of slots on an outer circumferential surface thereof which extend in a radial direction of the inner rotor, and a plurality of connection plates which transmit a rotational force from the outer rotor to the inner rotor, the respective connection plates having an outer radial end portion pivotably supported on an inner circumferential portion of the outer rotor and an inner radial end portion slidably received in the respective slots of the inner rotor, the connection plates dividing the space formed between the outer rotor and the inner rotor into a plurality of chambers.

With this construction, the permanent magnets disposed on the outer rotor and the coils disposed on the housing cooperate with each other to rotate the outer rotor. The rotation of the outer rotor is transmitted to the inner rotor through the plurality of connection plates, so that the outer rotor and the inner rotor are rotated at substantially the same rotational speed. There exists a generally crescent-shaped space between the outer rotor and the inner rotor, which is divided into the plurality of chambers by the connection plates. As the outer rotor and the inner rotor are rotated, a volume of the respective chambers is varied to thereby attain a pumping action to feed a pressurized fluid from the suction port to the discharge port.

In a second aspect of the present invention, there is provided the electrically powered pump according to the first aspect of the present invention, wherein the outer rotor includes plate supporting grooves formed on an inner circumferential surface of the outer rotor, and the outer radial end portion of the respective connection plates is pivotably fitted into the respective plate supporting grooves, and wherein the respective permanent magnets are disposed on the outer circumferential surface of the outer rotor in an angular range defined between respective adjacent two of the plate supporting grooves which are disposed adjacent to each other in a circumferential direction of the outer rotor. That is, the plate supporting grooves disposed on the inner radial side of the outer rotor and the permanent magnets disposed on the outer radial side of the outer rotor are arranged so as not to overlap with each other. With this arrangement, a thickness of the outer rotor in a radial direction of the outer rotor can be minimized.

In a third aspect of the present invention, there is provided the electrically powered pump according to the first aspect of the present invention, wherein at least one of the suction port and the discharge port is formed to be exposed to the outer circumferential surface of the outer rotor, and wherein the outer rotor is formed with a plurality of communication holes which extend through the outer rotor to communicate an outer circumferential side of the outer rotor and an inner circumferential side of the outer rotor with each other. With this construction, the fluid can be introduced from the suction port disposed on the outer radial side of the outer rotor into the respective chambers through the communication holes, and discharged from the respective chambers to the discharge port disposed on the outer radial side of the outer rotor through the communication holes.

In a fourth aspect of the present invention, there is provided the electrically powered pump according to the first aspect of the present invention, wherein the coils are non-uniform in number of turns corresponding to a pump stroke along the circumferential direction of the housing. With this construction, the outer rotor and the inner rotor can be rotated with higher efficiency.

In a fifth aspect of the present invention, there is provided the electrically powered pump according to the first aspect of the present invention, wherein a dimension of an air gap between stator magnetic poles formed by the respective coils and the outer circumferential surface of the outer rotor is non-uniform corresponding to a pump stroke along the circumferential direction of the housing. With this construction, the outer rotor and the inner rotor can be rotated with higher efficiency.

The electrically powered pump according to the present invention can attain the following effects. Since the electrically powered pump according to the present invention has the construction in which a motor section on the outer circumferential side of the electrically powered pump and a pump section on the inner circumferential side of the electrically powered pump are formed as a substantially one-piece or integral unit, a size of the electrically powered pump as a whole can be reduced. In particular, the outer rotor and the inner rotor which are not directly contacted with each other are connected with each other through a plurality of connection plates, and the inner rotor is rotated to follow the outer rotor at same rotational speed as that of the outer rotor. With this construction, sliding resistance which occurs between the outer rotor and the inner rotor can be extremely lowered, and a torque necessary to rotate the inner rotor and the outer rotor can be reduced. As a result, smooth rotation of the outer rotor and the inner rotor can be realized to thereby provide the electrically powered pump which can be used in practice.

DETAILED DESCRIPTION OF THE INVENTION

Figure 1:
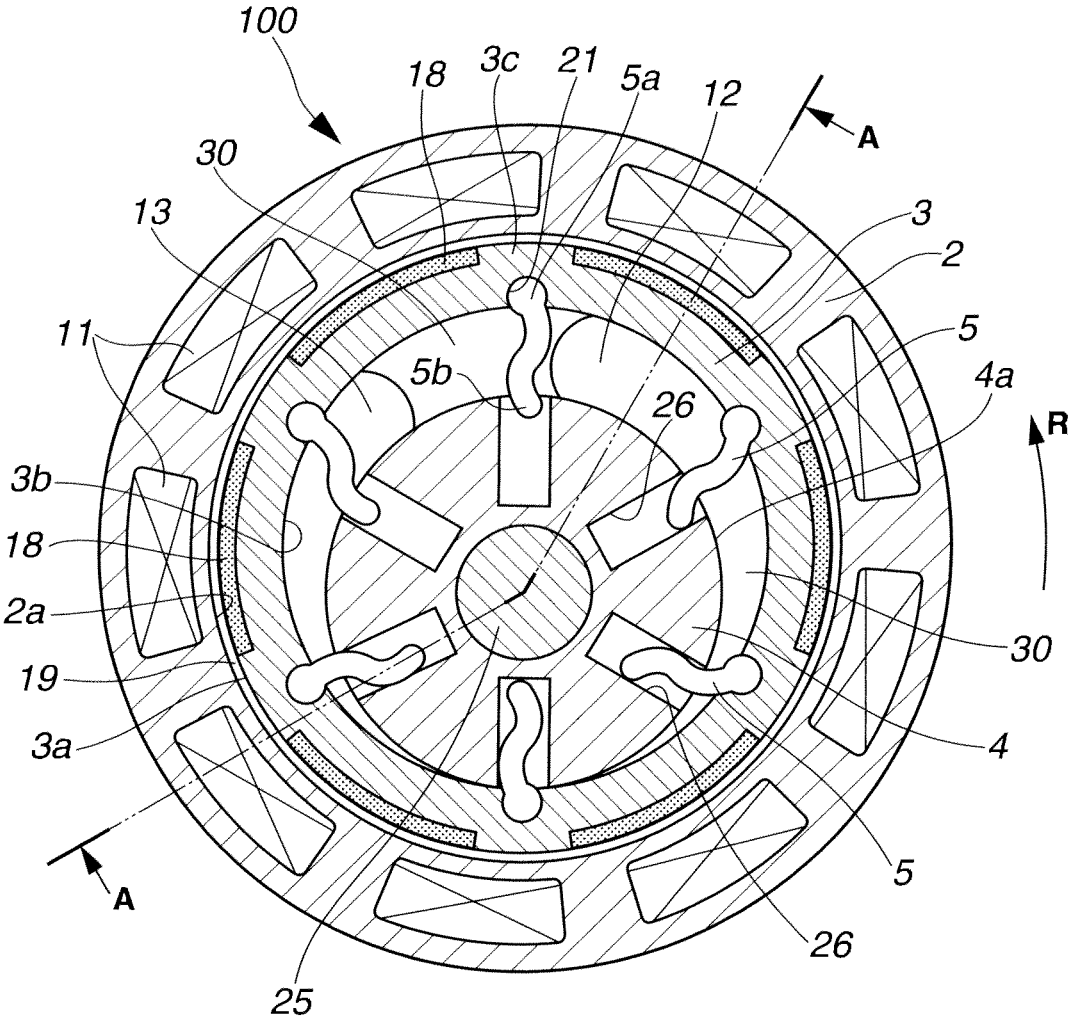
FIG. 1 is a cross-section of an electrically powered pump of a first embodiment according to the present invention, taken in a direction perpendicular to an axial direction of the electrically powered pump.
Figure 2:
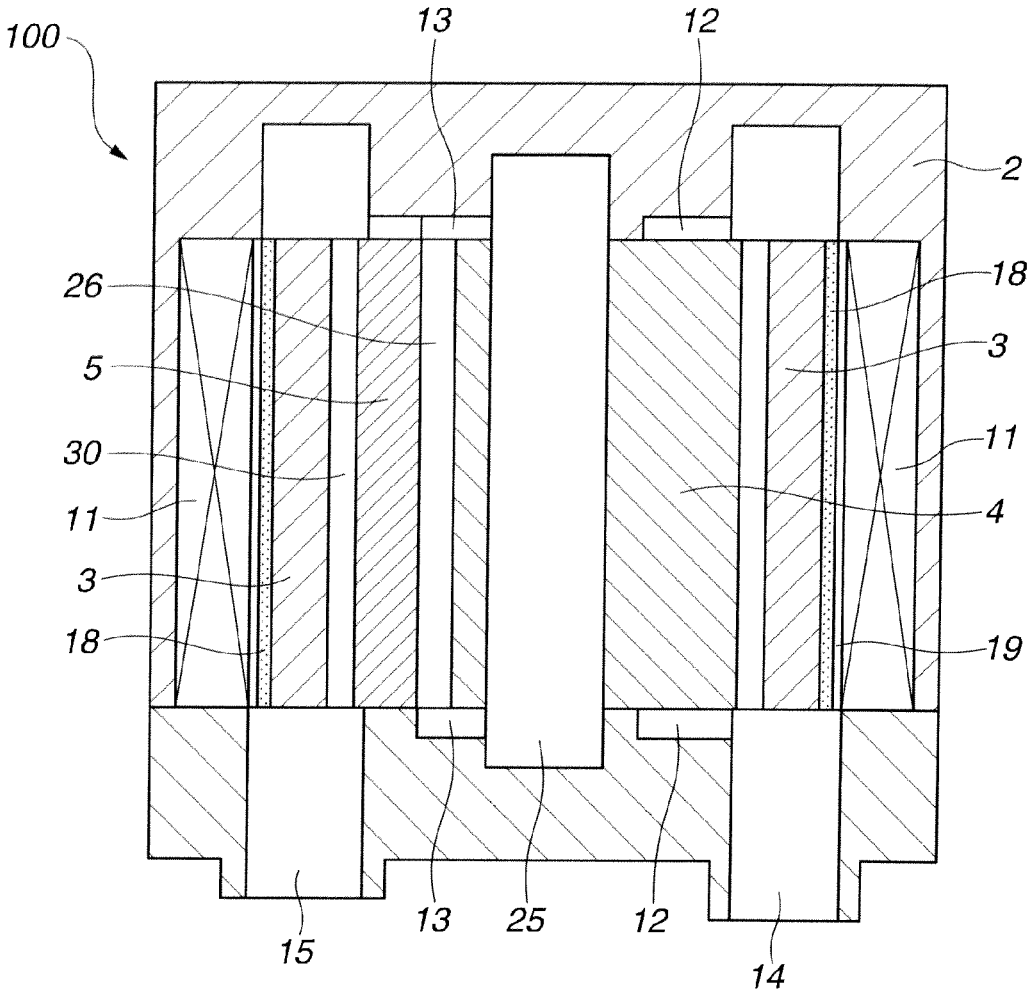
FIG. 2 is a cross-section of the electrically powered pump of the first embodiment, taken in the axial direction of the electrically powered pump and taken along line A-A shown in FIG. 1.

Referring now to FIG. 1 and FIG. 2, there is shown an electrically powered oil pump 100 as an electrically powered pump according to a first embodiment of the present invention. As seen from FIG. 1 and FIG. 2, the electrically powered oil pump 100 includes a generally cylindrical housing 2 having a cylindrical inner circumferential surface 2*a* which has a circular shape in section. The cylindrical inner circumferential surface 2*a* defines a cylindrical inside space of the housing 2 in cooperation with opposite inner axial end surfaces of the housing 2. Further, the electrically powered oil pump 100 includes a hollowed cylindrical outer rotor 3 fitted to the inner circumferential surface 2*a* of the housing 2, a cylindrical inner rotor 4 disposed on a radial inside of the outer rotor 3, and a plurality of connection plates 5 which connect the outer rotor 3 and the inner rotor 4 with each other.

The housing 2 serves as a stator which constitutes a motor section of the electrically powered oil pump 100 in cooperation with the outer rotor 3. Disposed in a circumferential wall of the housing 2 are a plurality of coils (for instance, in this embodiment, nine coils) 11 which are equidistantly spaced from each other in a circumferential direction of the housing 2. These coils 11 are wound on laminated iron-cores (not shown), respectively. The housing 2 is made of a synthetic resin material and molded together with the coils 11 wound on the laminated iron-cores. The respective coils 11 as schematically shown in FIG. 1 form stator magnetic poles as explained later. Further, the housing 2 includes a suction port 12 and a discharge port 13 which are respectively formed in opposite axial end walls of the housing 2. Both the suction port 12 and the discharge port 13 are respectively opened to the opposite inner axial end surfaces of the opposite axial end walls of the housing 2, and thereby exposed to the inside space of the housing 2. The suction port 12 and the discharge port 13 are spaced from each other in a circumferential direction of the housing 2 at a suitable angle therebetween around a central axis of the housing 2. As shown in FIG. 2, the suction port 12 and the discharge port 13 are respectively communicated with an inlet 14 and an outlet 15 which are opened to an outer axial end surface of the housing 2. Meanwhile, the suction port 12 may be formed in one of the opposite axial end walls of the housing 2, and the discharge port 13 may be formed in the other of the opposite axial end walls of the housing 2.

The outer rotor 3 constitutes a part of a pump section of the electrically powered oil pump 100 and also serves as a rotor of the motor section. The outer rotor 3 has a plurality of permanent magnets (for instance, six permanent magnets) 18 on an outer circumferential surface 3*a* thereof. The permanent magnets 18 are arranged to be equidistantly spaced from each other in a circumferential direction of the outer rotor 3. Each of the permanent magnets 18 has a curved plate shape having an arcuate shape in section as shown in FIG. 1. In this embodiment, the outer rotor 3 is made of a synthetic resin material and molded using a die in which the permanent magnets 18 are previously set in predetermined positions. As a result, the permanent magnets 18 are buried and embedded in the outer circumferential surface 3*a* of the outer rotor 3. The outer rotor 3 is fitted into the housing 2 with a slight clearance 19 between the outer circumferential surface 3*a* of the outer rotor 3 and the inner circumferential surface 2*a* of the housing 2, so that the outer rotor 3 is rotatable relative to the housing 2. The slight clearance 19 substantially serves as an air gap which forms a magnetic path. In this embodiment, there is not provided any shaft for restraining displacement of a rotation axis of the outer rotor 3. However, the outer rotor 3 is supported by the housing 2 through an oil film formed in the clearance 19, whereby the outer rotor 3 can be rotated in a coaxial relation to the housing 2. If necessary, a guide mechanism including annular grooves which are formed on the opposite inner surfaces of the axial end walls of the housing 2 may be provided to thereby attain centering of the outer rotor 3.

Figure 3:
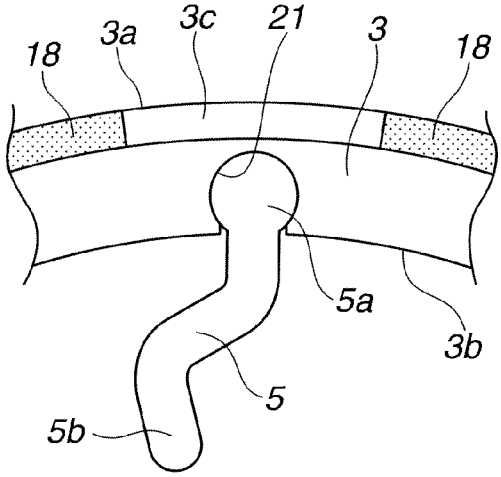
FIG. 3 is an enlarged cross-section of a connection plate used in the electrically powered pump.

The outer rotor 3 has a plurality of plate supporting grooves 21 on the inner circumferential surface 3*a*. Each of the plate supporting grooves 21 is so formed as to extend along an axial direction of the outer rotor 3 and has a generally circular shape in section as shown in FIG. 3. The plate supporting grooves (in this embodiment, six plate supporting grooves) 21 are arranged in an equidistantly spaced relation to each other in the circumferential direction of the outer rotor 3. In particular, when viewed in the circumferential direction of the outer rotor 3, the plate supporting grooves 21 are formed in non-overlap positions relative to the permanent magnets 18 in which the plate supporting grooves 21 are prevented from overlapping with the permanent magnets 18 disposed on the outer circumferential side of the outer rotor 3. That is, each of the permanent magnets 18 is located in an angular range which is defined between the adjacent two plate supporting grooves 21 disposed in the circumferential direction of the outer rotor 3 with respect to a central axis of the outer rotor. In other words, the plate supporting grooves 21 are formed in the resin portions 3*c* which are each located between the adjacent two permanent magnets 18 in the circumferential direction of the outer rotor 3. Thus, the permanent magnets 18 and the plate supporting grooves 21 are alternately arranged in the circumferential direction of the outer rotor 3 without overlapping with each other. With this construction, it is possible to ensure strength of the outer rotor 3 and reduce a thickness of the outer rotor 3 in the radial direction of the outer rotor 3.

The inner rotor 4 is rotatably supported in the housing 2 through a shaft 25 which is disposed in an eccentric position relative to the central axes of the housing 2 and the outer rotor 3. The inner rotor 4 has a plurality of slots (in this embodiment, six slots) 26 on an outer circumferential surface 4*a* of the inner rotor 4 which are disposed equidistantly in a circumferential direction of the inner rotor 4. The respective slots 26 extend in a radial direction of the inner rotor 4. In this embodiment, the shaft 25 is fixed to the housing 2, and the inner rotor 4 is fitted onto the shaft 25 extending through a central hole of the inner rotor 4. However, the shaft 25 may be fixed to the inner rotor 4 and rotatably supported by bearings on the side of the housing 2. Further, in this embodiment, the inner rotor 4 is formed into such a cylindrical shape that the outer circumferential surface 4*a* has a circular section. However, the inner rotor 4 may be configured such that the outer circumferential surface 4*a* has a non-circular section, for instance, a polygonal section (a hexagonal section in a case where the six slots is formed in the inner rotor 4 similar to this embodiment). The inner rotor 4 may be made of a synthetic resin material similarly to the outer rotor 2, or may be made of a die-cast light alloy. Further, as shown in FIG. 1, a portion of the outer circumferential surface 4*a* of the inner rotor 4 is disposed closer to the inner circumferential surface 3*b* of the outer rotor 3 and substantially contacted with the inner circumferential surface 3*b* of the outer rotor 3 via a fine clearance therebetween. However, this arrangement is not essential, and the inner rotor 4 may also be arranged relative to the outer rotor 3 such that a certain small clearance is formed between the inner circumferential surface 3*b* of the outer rotor 3 and a portion of the outer circumferential surface 4*a* of the inner rotor 4 at the position where the inner rotor 4 is located closest to the outer rotor 3.

With the above arrangement in which the inner rotor 4 is located in the eccentric position relative to the inner circumferential surface 3*b* of the outer rotor 3, a generally crescent-shaped space is formed between the outer circumferential surface 4*a* of the inner rotor 4 and the inner circumferential surface 3*b* of the outer rotor 3 as shown in FIG. 1. The suction port 12 and the discharge port 13 are opened into the generally crescent-shaped space. The generally crescent-shaped space is divided into a plurality of chambers (in this embodiment, six chambers) 30 by a plurality of connection plates (in this embodiment, six connection plates) 5 which extend in the radial direction of the inner rotor 4, respectively. Each of the respective connection plates 5 has a curved plate shape, specifically, a generally "S" shape as shown in FIG. 3. The connection plate 5 has a head portion 5*a* on an outer radial end portion thereof and a tail portion 5*b* on an inner radial end portion thereof. The head portion 5*a* has a generally circular shape in section and is pivotably fitted to the plate supporting groove 21 of the outer rotor 3. The tail portion 5*b* is slidably received in the slot 26 of the inner rotor 4.

As readily understood from FIG. 1, in accordance with a change in rotational positions of the outer rotor 3 and the inner rotor 4 which are located in the eccentric relation to each other, a distance between the inner circumferential surface 3*b* of the outer rotor 3 and the outer circumferential surface 4*a* of the inner rotor 4 is varied, and a relative angular position of the respective plate supporting grooves 21 and the respective slots 26 is varied. Accordingly, a portion of the respective connection plates 5 on the side of the tail portion 5*b* is allowed to slidably move in the slot 26 in radially inward and outward directions of the inner rotor 4, and according to this movement, an attitude of the respective connection plates 5 with respect to the slots 26 is changed. When the outer rotor 3 is rotated in a counterclockwise direction as indicated by arrow R in FIG. 1, the connection plates 5 basically urge the inner rotor 4 to move in the same direction as that of the rotation of the outer rotor 3. At this time, since each of the connection plates 5 has such a curved shape as the generally "S" shape as shown in FIG. 1, the connection plate 5 can be inclined relative to a peripheral wall surface defining the slot 26 while slidably moving in the slot 26 in the radially inward and outward directions of the inner rotor 4. Further, owing to the curved shape such as the generally "S" shape of the connection plate 5, a clearance formed between the connection plate 5 and the peripheral wall surface defining the slot 26 can be relatively reduced.

A volume of the respective chambers 30 defined by the outer rotor 3, the inner rotor 4 and the respective connection plates 5 is varied in accordance with rotation of the outer rotor 3 and the inner rotor 4. When the outer rotor 3 and the inner rotor 4 are in the rotational positions as shown in FIG. 1, the volume of the chamber 30 located on the right lower side as shown in FIG. 1 is the minimum. As the outer rotor 3 is rotationally moved from the position shown in FIG. 1 in the counterclockwise direction as indicated by arrow R, the volume of the chamber 30 is gradually increased. Then, the volume of the chamber 30 located on the upper side as shown in FIG. 1 becomes maximum. After that, the volume of the chamber 30 is decreased in accordance with the counterclockwise rotation of the outer rotor 3. Accordingly, similarly to the conventional vane pump as generally known, the electrically powered oil pump 100 can attain a pump function by which a pressurized oil is fed from the suction port 12 as shown on the right side of FIG. 1 to the discharge port 13 as shown on the left side of FIG. 1.

Figure 4:
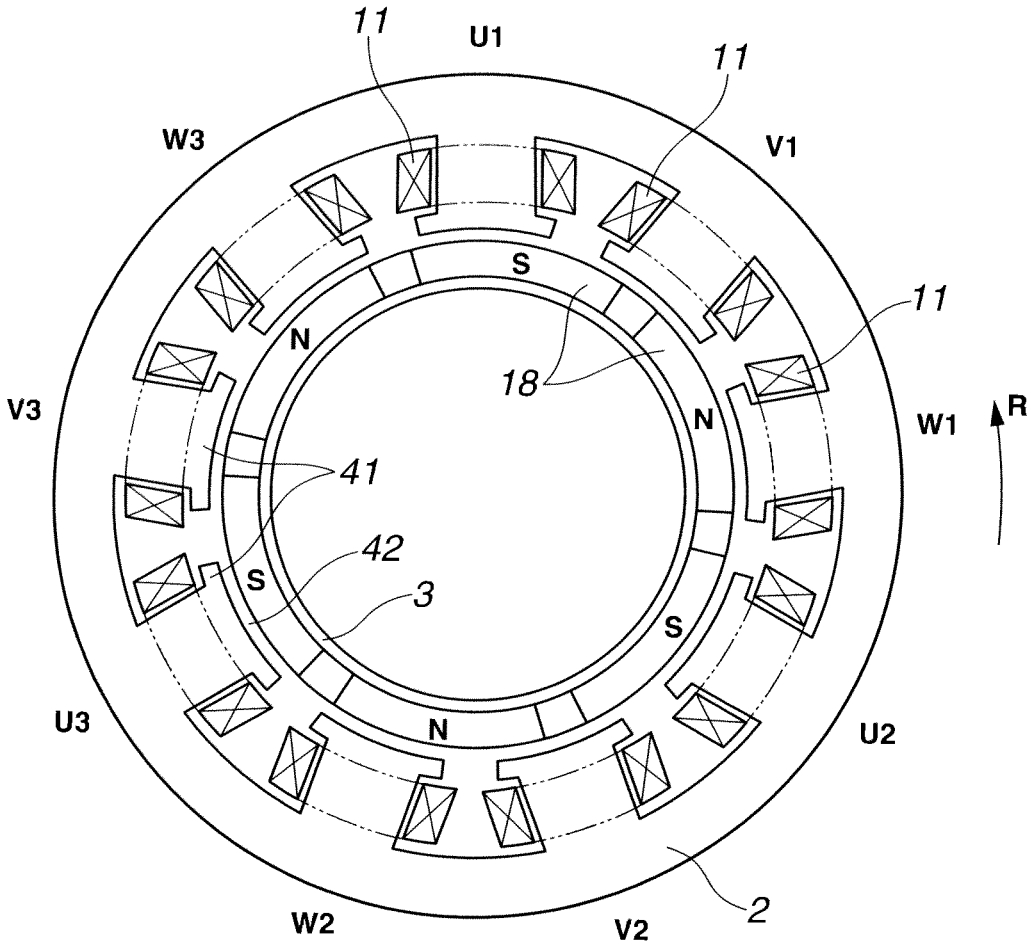
FIG. 4 is an explanatory diagram showing a relationship between permanent magnets and coils of a motor section of the electrically powered pump of the first embodiment.

Referring to FIG. 4, there is shown a construction of the motor section which is constituted of the housing 2 as the stator of the motor section and the outer rotor 3 as the rotor of the motor section. As shown in FIG. 4, in this embodiment, nine coils 11 are disposed on the housing 2, and the six permanent magnets 18 are disposed on the outer rotor 3. The nine coils 11 are divided into three groups, i.e., three coil units U1-U3, V1-V3 and W1-W3. The respective coil units U1-U3, V1-V3 and W1-W3 are located in angular positions being offset from each other around the central axis of the housing 2. The six permanent magnets 18 are arranged such that N poles and S poles are alternately located in the circumferential direction of the outer rotor 3. Thus, the motor section is constructed as a three-phase six-pole nine-slot brushless motor. Connection of the coils 11 may be either a delta connection or a star connection. The outer rotor 3 is driven to rotate in the counterclockwise direction via a driving circuit (not shown). Meanwhile, the number of the permanent magnets 18 and the number of the coils 11 are not particularly limited to those of this embodiment, and various modifications of the motor section, for instance, an eight-pole twelve-slot type may be used.

As clearly understood from comparison between FIG. 1 and FIG. 4, in this embodiment, the number of the permanent magnets 18 is an even number, and therefore, the number of connection plates 5 disposed between the permanent magnets 18 is the same even number as that of the permanent magnets 18.

In the electrically powered oil pump 100 according to the above described embodiment, as compared to the construction of the conventional art in which the electric motor and the pump are connected in series in the axial direction, an axial dimension of the electrically powered oil pump 100 can be considerably reduced. In addition, since the outer rotor 3 serves as both a part of the pump section and a part of the motor section, the electrically powered oil pump 100 as a whole can be considerably downsized. Further, in the electrically powered oil pump 100 according to the above described embodiment, rotation of the outer rotor 3 is transmitted to the inner rotor 4 through the six connection plate 5, and the inner rotor 4 is rotated at the same speed as that of the outer rotor 3. Therefore, the rotation force of the outer rotor 3 is shared by and transmitted to a plurality of circumferential portions of the inner rotor 4 in which the slots 26 are formed. Further, the inner rotor 4 and the outer rotor 3 can be prevented from undergoing a forcible contact (a frictional contact) therebetween, so that the inner rotor 4 can be smoothly rotated to follow the outer rotor 3. As a result, there is provided the compact electrically powered oil pump 100 which can be used in practice in view of efficiency and durability. Furthermore, in the electrically powered oil pump 100 according to the above described embodiment, the permanent magnets 18 and the plate supporting grooves 21 are arranged in the outer rotor 3 so as not to overlap with each other in the circumferential direction of the outer rotor 3. With this arrangement, a thickness of the outer rotor 3 in the radial direction of the outer rotor 3 can be minimized. As a result, an outer diameter of the electrically powered oil pump 100 as a whole can be reduced.

Figure 5:
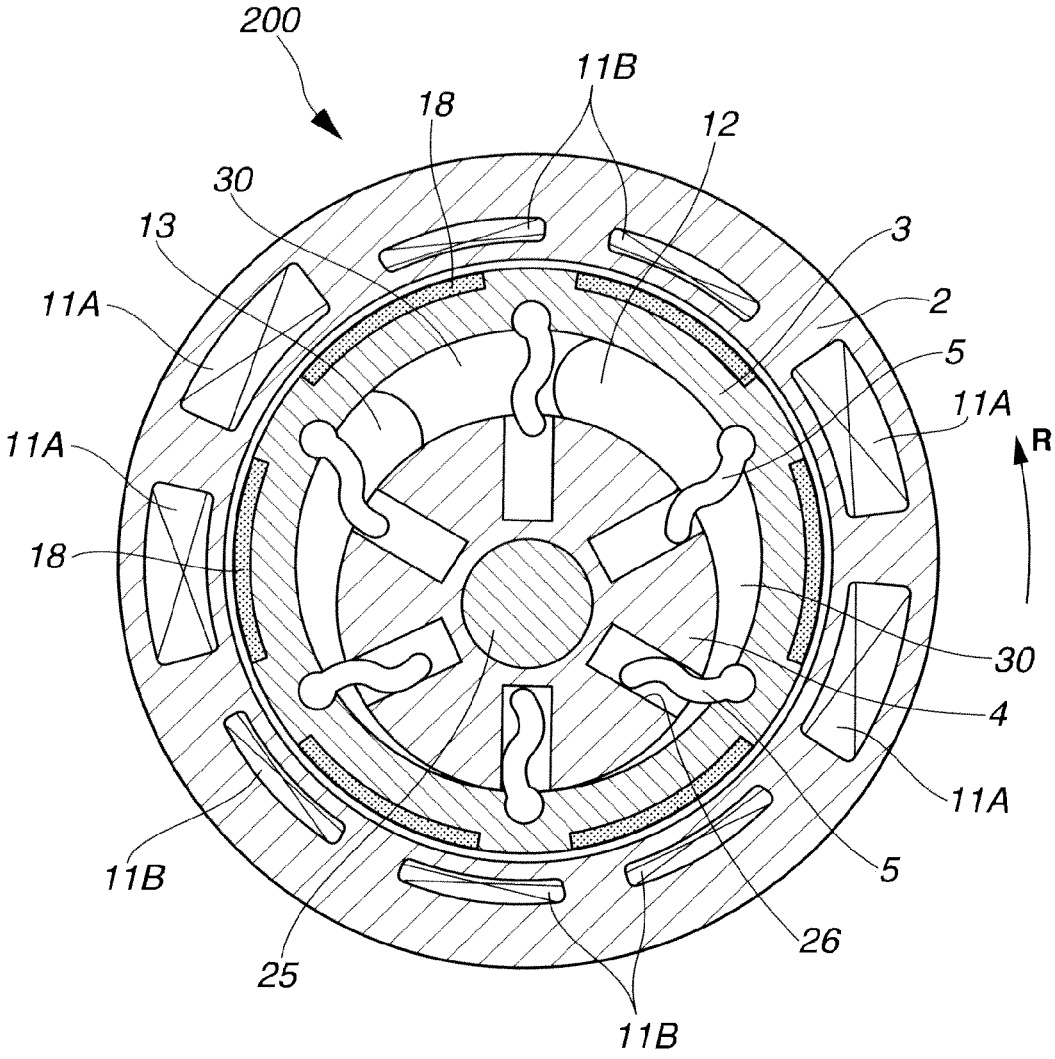
FIG. 5 is a cross-section of an electrically powered pump of a second embodiment according to the present invention, showing coils which are different in dimension from each other.

Referring to FIG. 5, there is shown an electrically powered oil pump 200 as the electrically powered pump according to a second embodiment of the present invention. The second embodiment differs from the first embodiment in that the coils are non-uniform in number of turns corresponding to the pump stroke along the circumferential direction of the housing 2. Specifically, the coils 11 arranged in the circumferential direction of the housing 2 are divided into two groups including one group constituted of the coils 11 each having an increased number of turns and the other group constituted of the coils 11 each having a reduced number of turns, in consideration of a pump stroke at which the respective chambers 30 proceed in the circumferential direction of the housing 2. Like references denote like parts, and therefore, detailed explanations therefor are omitted. Specifically, as shown in FIG. 5, the electrically powered oil pump 200 includes four large coils 11A each being relatively large in number of turns, and five small coils 11B each being relatively small in number of turns. That is, when the respective chambers 30 which perform the pumping action reach a position immediately before the discharge port 13, the respective chambers 30 undergo a largest reaction force due to an oil pressure which acts as a resistance against the rotation of the outer rotor 3. For this reason, in the electrically powered oil pump 200, a portion of the circumferential wall of the housing 2 in which the resistance against the rotation of the outer rotor 3 becomes larger and another portion of the circumferential wall of the housing 2 which is different in phase from the above portion by 180° have the coils 11 each being increased in number of turns to thereby enhance a magnetic force which is generated from the coil 11. On the other hand, the remaining portions of the circumferential wall of the housing 2 have the coils 11 each being decreased in number of turns. With this construction, the outer rotor 3 and the inner rotor 4 can be rotated with higher efficiency.

Instead of changing the number of turns in each of the coils 11 as described above (or in addition to the changing), a dimension of an air gap 42 between the respective permanent magnets 18 and the respective stator magnetic poles 41 as shown in FIG. 4 may be changed every coil 11 to thereby appropriately adjust the magnetic force which is generated between the respective stator magnetic poles 41 and the respective permanent magnets 18.

Figure 6:
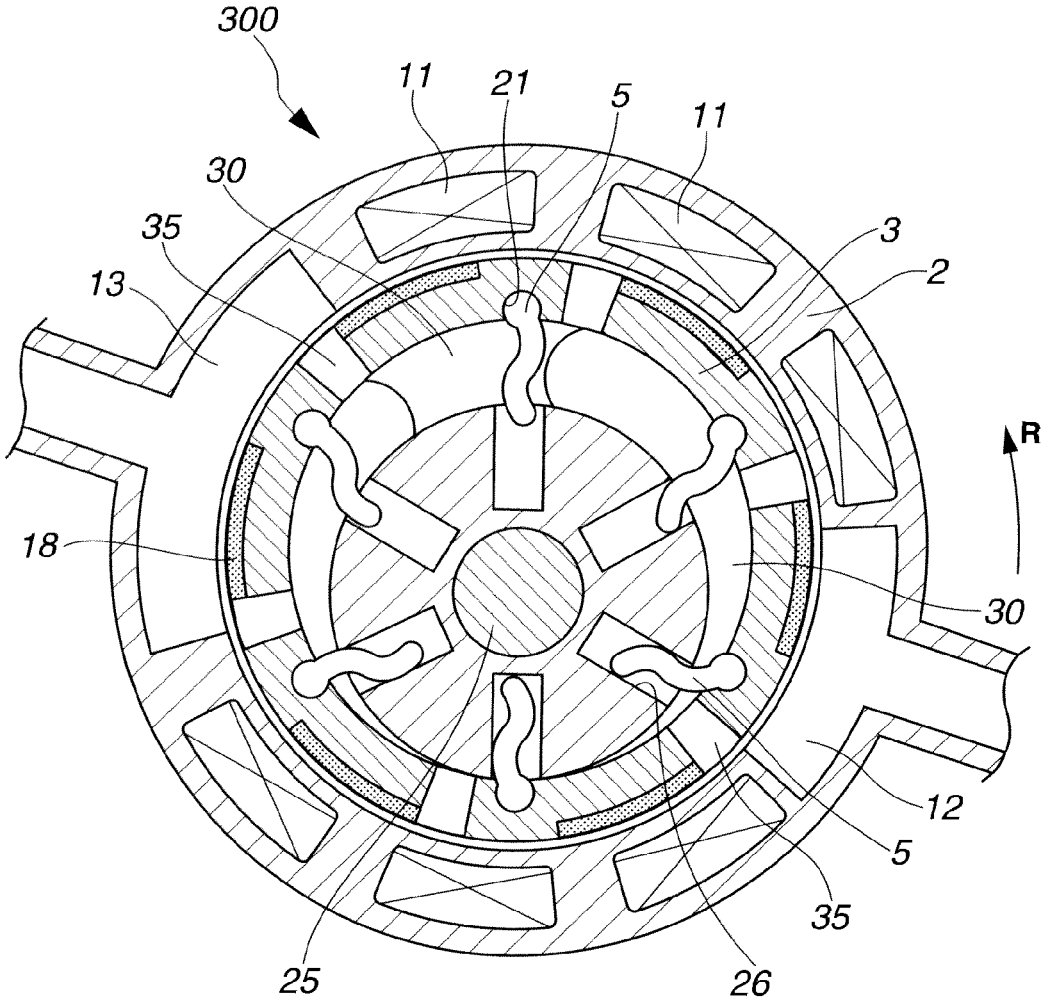
FIG. 6 is a cross-section of an electrically powered pump of a third embodiment according to the present invention, showing a suction port and a discharge port which are disposed in a diametrically opposed relation to each other on the radially outer side of the electrically powered pump.

Next, referring to FIG. 6, there is shown an electrically powered oil pump 300 as the electrically powered pump according to a third embodiment of the present invention. As shown in FIG. 6, the electrically powered oil pump 300 includes the suction port 12 and the discharge port 13 which are disposed in the circumferential wall of the housing 2 in an angularly offset relation to each other by 180° (that is, in a diametrically opposed relation to each other) with respect to the central axis of the housing 2. The suction port 12 and the discharge port 13 are exposed to the outer circumferential surface 3*a* of the outer rotor 3. The outer rotor 3 includes a plurality of communication holes (in this embodiment, six communication holes) 35 which extend through the outer rotor 3 along the radial direction of the outer rotor 3 and communicate the radial outside of the outer rotor 3 with the radial inside of the outer rotor 3. The respective communication holes 35 have an inner radial end opened to the respective chambers 30. When the outer rotor 3 is located in a rotational position where the communication holes 35 overlap with the suction port 12 or the discharge port 13 in the radial direction of the outer rotor 3, the suction port 12 and the discharge port 13 are communicated with the corresponding chambers 30 through the communication holes 35. Further, in the electrically powered oil pump 300 according to the third embodiment, a dimension of the respective permanent magnets 18 is reduced so as to prevent the permanent magnets 18 from overlapping with the communication holes 35 in the circumferential direction of the outer rotor 3, and the respective communication holes 35 are formed adjacent to a side edge of the respective permanent magnets 18. Further, the plate supporting grooves 21 are formed between the communication holes 35 and the permanent magnets 18, respectively. However, the respective permanent magnets 18 may be formed with a cutout or an opening to which the respective communication holes 35 are connected. In this case, the permanent magnets 18 can be free from limitation in size. Further, in the electrically powered oil pump 300 according to the third embodiment, the motor section has a non-uniform six-pole six-slot motor construction in which the suction port 12 and the discharge port 113 occupy the diametrically opposed portions of the circumferential wall of the housing 2, and six coils 11 are arranged in the remaining portion of the circumferential wall of the housing 2 in a spaced relation to each other in the circumferential direction of the housing 2. However, both the suction port 12 and the discharge port 113 may be disposed in one of the opposite axial end walls of the housing 2, the coils 11 may be arranged in the circumferential wall of the housing 2 in a spaced relation to each other in the circumferential direction of the housing 2. In this case, the motor section can have a nine-slot motor construction, for instance, as shown in FIG. 1, in which nine coils 11 are arranged in the circumferential wall of the housing 2 in a spaced relation to each other in the circumferential direction of the housing 2.

As described above, in the electrically powered oil pump 300, the suction port 12 and the discharge port 13 may be arranged on the outer circumferential side of the electrically powered oil pump 300. With this arrangement, a freedom of layout of the electrically powered oil pump 300 can be increased, and particularly, an axial dimension of the electrically powered oil pump 300 can be reduced.

Figure 7:
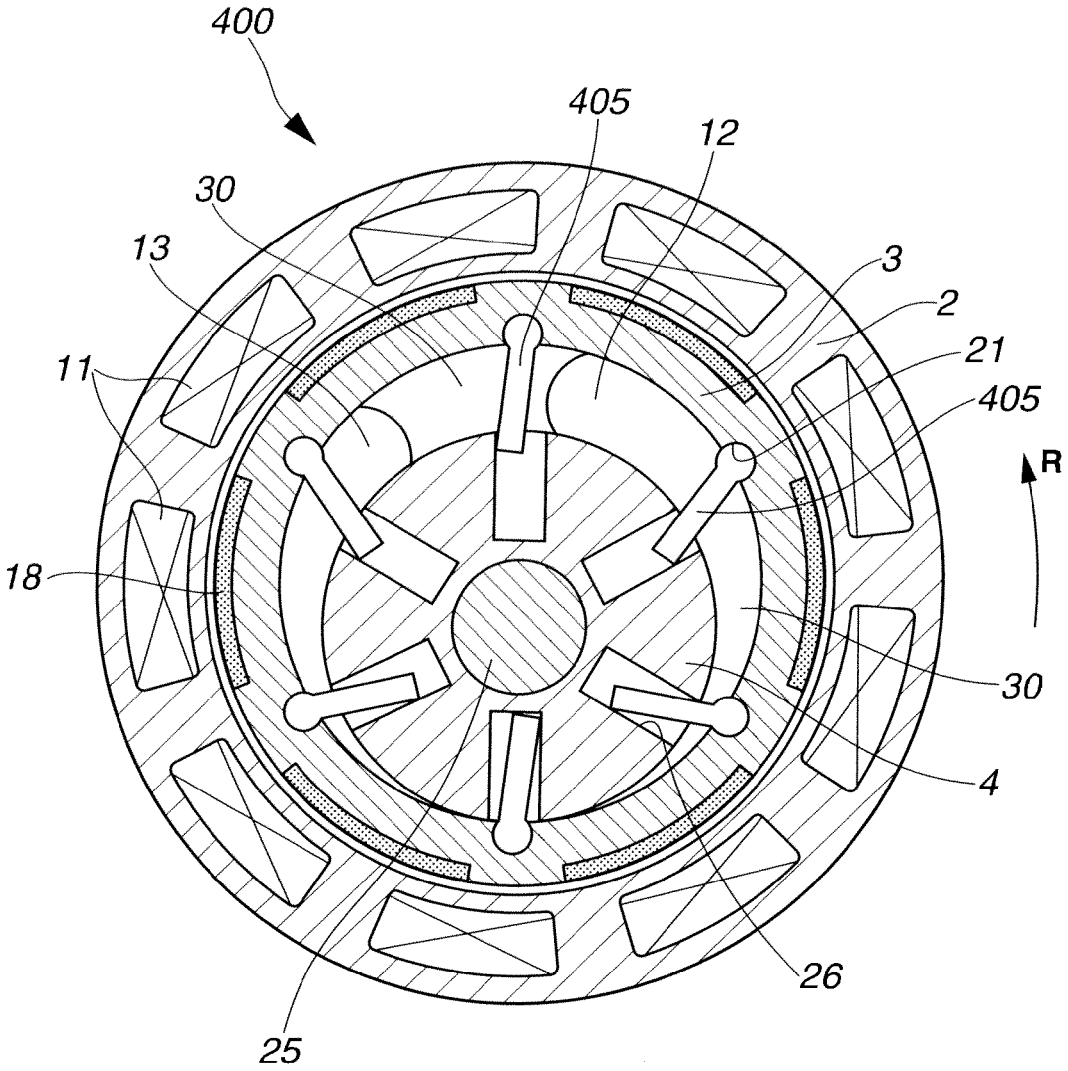
FIG. 7 is a cross-section of an electrically powered pump of a fourth embodiment according to the present invention, showing connection plates which are different in shape from those of the first embodiment.

Referring to FIG. 7, there is shown an electrically powered oil pump 400 as the electrically powered pump according to the fourth embodiment which differs from the first embodiment in configuration of the connection plates. As shown in FIG. 7, the electrically powered oil pump 400 includes connection plates 405 each having a simplified flat-plate shape. Even in a case where the connection plates 405 have such a simplified flat-plate shape, the outer rotor 3 and the inner rotor 4 can be connected through a plurality of portions of the connection plates 405. As a result, the inner rotor 4 can be smoothly rotated to follow the outer rotor 3, thereby performing the pumping action.

This application is based on a prior Japanese Patent Application No. 2010-215736 filed on Sep. 27, 2010. The entire contents of the Japanese Patent Application No. 2010-215736 are hereby incorporated by reference.

Although the invention has been described above by reference to certain embodiments of the invention, the invention is not limited to the embodiments described above. Further modifications and variations of the embodiments described above will occur to those skilled in the art in light of the above teachings. The scope of the invention is defined with reference to the following claims.

What is claimed is:

1. An electrically powered pump, comprising:

a housing comprising:

a suction port, a discharge port, and a plurality of coils disposed in a circumferential direction of the housing, the housing having a cylindrical inner circumferential surface having a circular shape in section, a cylindrical outer rotor rotatably disposed on an inner circumferential side of the housing, the outer rotor having a plurality of permanent magnets on an outer circumferential surface thereof which comprise a motor section in cooperation with the plurality of coils of the housing, an inner rotor disposed on an inner circumferential side of the outer rotor so as to be rotatable about a rotation axis eccentric relative to a central axis of the outer rotor, the inner rotor cooperating with the outer rotor to form a space therebetween which is communicated with the suction port and the discharge port, the inner rotor having a plurality of slots on an outer circumferential surface thereof which extend in a radial direction of the inner rotor, and a plurality of connection plates which transmit a rotational force from the outer rotor to the inner rotor, the respective connection plates having an outer radial end portion pivotably supported on an inner circumferential portion of the outer rotor and an inner radial end portion slidably received in the respective slots of the inner rotor, the connection plates dividing the space formed between the outer rotor and the inner rotor into a plurality of chambers, wherein the outer rotor comprises plate supporting grooves formed on an inner circumferential surface of the outer rotor, and the outer radial end portion of the respective connection plates is pivotably fitted into the respective plate supporting grooves, wherein the respective permanent magnets are disposed on the outer circumferential surface of the outer rotor in an angular range defined between respective pairs of the plate supporting grooves which are disposed adjacent to each other in a circumferential direction of the outer rotor, and wherein the respective permanent magnets and the respective plate supporting grooves are alternately arranged in the circumferential direction of the outer rotor without overlapping each other.

2. The electrically powered pump as claimed in claim 1, wherein at least one of the suction port and the discharge port is formed to be exposed to the outer circumferential surface of the outer rotor, and wherein the outer rotor is formed with a plurality of communication holes which extend through the outer rotor to communicate an outer circumferential side of the outer rotor and the inner circumferential side of the outer rotor with each other.

3. The electrically powered pump as claimed in claim 2, wherein the respective communication holes are disposed adjacent to a side edge of the respective permanent magnets in the circumferential direction of the outer rotor.

4. The electrically powered pump as claimed in claim 1, wherein the coils are non-uniform in a number of turns corresponding to a pump stroke along the circumferential direction of the housing.

5. The electrically powered pump as claimed in claim 1, wherein an air gap exists between stator magnetic poles formed by the respective coils and the outer circumferential surface of the outer rotor, wherein the air-gap is non-uniform in a dimension of the air gap corresponding to a pump stroke along the circumferential direction of the housing.

6. The electrically powered pump as claimed in claim 1, wherein the suction port and the discharge port are disposed in opposite axial end surfaces of the housing so as to be exposed to an inside space of the housing which is defined by the cylindrical inner circumferential surface of the housing in cooperation with the opposite axial end surfaces.

7. The electrically powered pump as claimed in claim 1, wherein the respective connection plates have a curved plate shape.

8. The electrically powered pump as claimed in claim 1, wherein the respective connection plates have a flat plate shape.

* * * * *